United States Patent [19]

Cobb, III et al.

[11] Patent Number: 4,837,545

[45] Date of Patent: Jun. 6, 1989

[54] MINIATURE CIRCUIT BREAKER WITH IMPROVED LONGEVITY

[75] Inventors: Carleton M. Cobb, III, East Walpole; Hans G. Hirsbrunner, Attleboro; Edward M. Gonsalves, Swansea; Richard L. Jenne, Attleboro, all of Mass.; Sepideh H. Nott, Portsmouth, R.I.

[73] Assignee: Texas Instruments Incorporated, Dallas, Tex.

[21] Appl. No.: 161,069

[22] Filed: Feb. 26, 1988

Related U.S. Application Data

[62] Division of Ser. No. 34,174, Apr. 2, 1987.

[51] Int. Cl.[4] ..... H01H 71/04; H01H 73/12

[52] U.S. Cl. ..... 337/66; 337/70; 335/191

[58] Field of Search ..... 337/66, 59, 70; 335/190, 191; 200/153 G

[56] References Cited

U.S. PATENT DOCUMENTS

| | | | |
|---|---|---|---|
| 2,829,219 | 4/1958 | Christensen | 337/59 |
| 4,330,772 | 5/1982 | Hastings et al. | 337/66 |
| 4,612,528 | 9/1986 | Peter | 337/66 |

*Primary Examiner*—H. Broome

*Attorney, Agent, or Firm*—John A. Haug; James P. McAndrews; Melvin Sharp

[57] ABSTRACT

A circuit breaker device has a chamber in which is disposed a single break contact system using low contact resistance material mounted on movable and stationary supports arranged in a loop configuration in order to direct arcs between the contacts through an arc chute into a remote portion of the chamber. A push-button is connected through a kinematic linkage which transfers motion using minimal frictional engagement to a movable contact to bring the movable contact into and out of engagement with a stationary contact and to latch the contacts in engagement during normal operation. A cantilevered current carrying bimetal transfers motion caused by I R heating of the bimetal to an ambient compensating bimetal connected to the latch mechanism. The kinematic linkage includes a latch surface which engages a rollable cylindrical reaction surface of the latch mechanism to cause the movable contact to come into engagement with the stationary contact upon depression of the push-button. Upon overload, the latch mechanism is displaced with the latch surface moving away from the reaction surface allowing return springs to return the push-button to its unactuated position and separate the contacts.

8 Claims, 11 Drawing Sheets

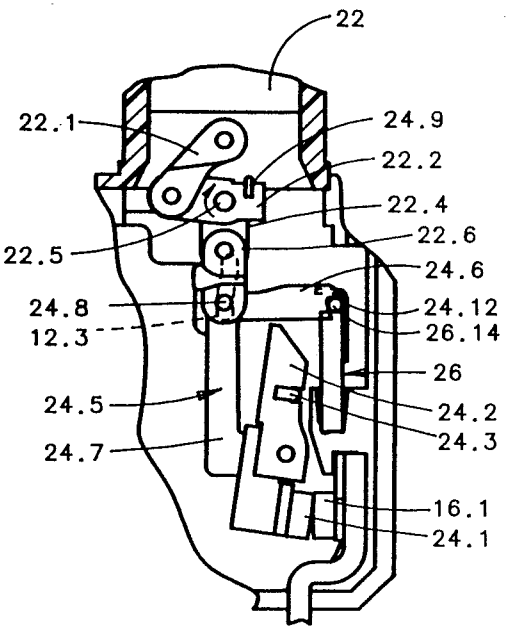
Fig. 16
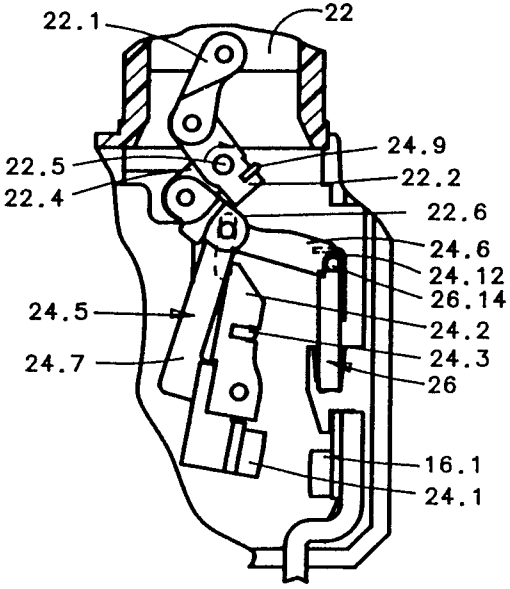
Fig. 17
Fig. 18

MINIATURE CIRCUIT BREAKER WITH IMPROVED LONGEVITY

This application is a division, of application Ser. No. 034,174, filed Apr. 2, 1987.

BACKGROUND OF THE INVENTION

This invention relates generally to miniature circuit breaker devices and more particularly to such devices which are adapted to switch electric loads, as well as provide overcurrent protection for such loads.

One of the primary uses of circuit breakers of the type with which the invention relates is to switch and protect electrical loads, in aircraft. To be acceptable for this purpose, such circuit breakers need to be small in size yet highly reliable. Such devices are manually actuatable, as well as being responsive to open circuits upon current overloads.

One such circuit breaker which has found wide acceptance is disclosed and claimed in U.S. Pat. No. 3,361,882. In accordance with this patent, the circuit breaker includes first current carrying and second ambient compensating thermostatic elements mounted in a casing, each having an end free for movement, with a slide adapter to transfer motion from the free end of the first element to the free end of the second element. A catch is attached to the second thermostatic element and movable therewith and is adapted to cooperate with a first latch rotatably mounted at the end of a plunger. A bridging movable contact is carried by the latch and is moved thereby to engage and disengage a pair of stationary contacts. A second latch engages the plunger to maintain the plunger in a position with the contacts in engagement and is releasable to permit the plunger under the influence of a return spring to move toward an open contact position when the first latch is released from the catch. The free ends of the bimetallic elements move the same amount under varying ambient temperatures to maintain the same relative position of the first latch and the catch.

Although the above described circuit breaker is very effective and has a life expentancy exceeding 2500 cycles, it has become desirable to provide a device which has even greater life expectancy, as well as one which has a wider current carrying range of ratings and improved immunity to vibration.

For example, in the above referenced circuit breaker, one of the limiting factors regarding useful product life is the fact that a ball latch mechanism is used to maintain the contacts in the closed position. Due to the fact that the spherical elements experience wear, they thereby affect calibration of the device and deleteriously limit its longevity. Further, the catch and first latch are subjected to high frictional forces which results in changing in the calibrated current levels for tripping the breaker over the life of the device.

SUMMARY OF THE INVENTION

It is therefore an object of the invention to provide an improved circuit breaker which has enhanced life expectancy of up to 50,000 cycles or more. Another object is the provision of a circuit breaker which has improved contact force and low contact resistance to contribute to increased useful life. Yet another object is the provision of a circuit breaker in which the latching mechanism operates with a minimum of friction to further contribute to increased useful life. Still another object is the provision of a circuit breaker device that has improved vibration immunity, both sinusoidal and random. other objects of the invention include the provision of a circuit breaker which is trip-free, ambient compensated, easily calibrated, one which provides visual indication that the circuit breaker has tripped, one which can be used as a manually operated switch without deleterious effects on its function of responding properly to overloads, and one which is small and economical to manufacture.

Other objects will be in part apparent and in part pointed out hereafter.

Briefly, in accordance with the invention a single break contact system uses mating contacts formed of low electrical resistance material mounted on electrically conductive support structures configured to direct arcing between the contacts into an arc chute leading to a remote portion of the chamber in which the contact system is disposed. The chute is formed by spaced electrically insulative walls having ribs formed therein to provide arc shadows to interrupt tracking of contact material deposited on the side walls as a result of the arcing.

According to a feature of the invention, a push-button is connected to a kinematic linkage which transfers motion to the movable contact and latch mechanism. The kinematic linkage includes a toggle configured as a bellcrank with its fulcrum rotatably attached to a fixed location of the circuit breaker housing. One leg of the bellcrank toggle is connected through a pivotable link to the push-button which is confined to vertical motion while the other leg of the bellcrank toggle is connected through a pivotable link to a second bellcrank configured element. A push-button return spring is attached to the bellcrank toggle placing a rotational force on the toggle tending to move the button upwardly. The second bellcrank configured element has its fulcrum confined to a selected, primarily vertical, linear motion by means of a pin riding in a pair of oppositely disposed grooves. The second bellcrank element has a latch surface on one arm and has its other arm connected to the movable contact arm. As the push-button moves downwardly upon actuation, the bellcrank toggle rotates against the bias of the push-button return spring forcing the second bellcrank element downwardly with the latch surface contacting a reaction surface formed on a rockably mounted support. Further downward movement of the push-button causes the second bellcrank element to pivot as it descends until the movable contact engages the stationary contact which has a vertically disposed contact surface. The movable contact arm extends along the other arm of the second bellcrank element with a contact arm return spring urging the extended portion of the movable arm and the other arm of the bellcrank element toward one another and the assembly away from the stationary contact. As the contacts move into engagement further downward motion of the second bellcrank element fulcrum causes the movable contact arm to pivot against the bias of the contact arm return spring with the movable contact sliding across the surface of stationary contact until a pin carried by the distal portion of the other leg of the bellcrank toggle goes over center, relative to an imaginary line extending through the fulcrum of the bellcrank toggle and fulcrum of the second belcrank element, to a latched position.

According to a feature of the invention, the reaction surface is a rotatable cylindrical pin mounted in a pin cage on the top of the rockably mounted support. A current carrying bimetal which is cantilever mounted has a free end which deflects upon being subjected to increasing temperature caused by overload current. The deflection is transmitted by a slide member to the rockably mounted support causing the pin, which is in engagement with the latching surface on the second bellcrank element, to roll along the top of the support until the latching surface is no longer supported, thereby allowing the contact arm return spring acting on the movable contact arm and the other arm of the second bellcrank element to move away from the stationary contact and allow the pushbutton return spring to rotate the bellcrank link, returning the push-button to its unactuated-up-position. The reaction surface pin is returned to its original position once the latching surface is placed out of contact with the pin by means of spring member mounted on the support.

According to yet another feature of the invention, the current carrying bimetallic member has one end insert molded in high temperature resinous material anchored in the housing of the circuit breaker. Although the bimetallic member may be in the form of a strip of material forming a single loop for a particular current rating, for other current ratings the strip could form several loops extending from the anchored end to a free distal end. In such cases where there are a plurality of loops, the free distal end is also insert molded in a block of high temperature resinous material to provide improved alignment and vibration immunity.

A suitable slide member extends from the free distal end of the current carrying bimetal to the free distal end of a cantilever mounted strip of bimetal serving as an ambient temperature compensator. The ambient compensating bimetal has an end attached to a bracket which is attached to the rockably mounted latch support member. A threaded calibration member is received in a threaded bore through the latch support member and is attached to the bracket so that the position of the distal end of the compensating bimetal can be adjusted relative to the support member to provide precise calibration of the amount of displacement, and hence the calibrated level of current required to effect such displacement, to cause separation of the latch and reaction surfaces.

Yet another feature of the invention is the provision of an alternative embodiment in which a fusible link is serially connected to one of the terminal means to provide a dual safety mechanism.

The invention accordingly comprises the constructions hereinafter described, the scope of the invention being indicated in the appended claims.

BRIEF DESCRIPTION OF THE DRAWINGS

In the accompanying drawings, in which several of various possible embodiments are illustrated.

FIG. 16 shows a portion of the FIG. 15 structure displaying the toggle mechanism, latching mechanism and contact structure with certain parts broken away or removed for clarity of illustration showing the circuit breaker in the contacts open or disengaged position;

FIG. 17 is a view similar to FIG. 16 showing the circuit breaker in the initial stage of the latched position;

FIG. 18 is a view similar to FIG. 16 showing the device at the initial overcenter stage of the latched position;

Corresponding reference characters indicate corresponding parts throughout the drawings.

DESCRIPTION OF PREFERRED EMBODIMENTS

Figure 1:
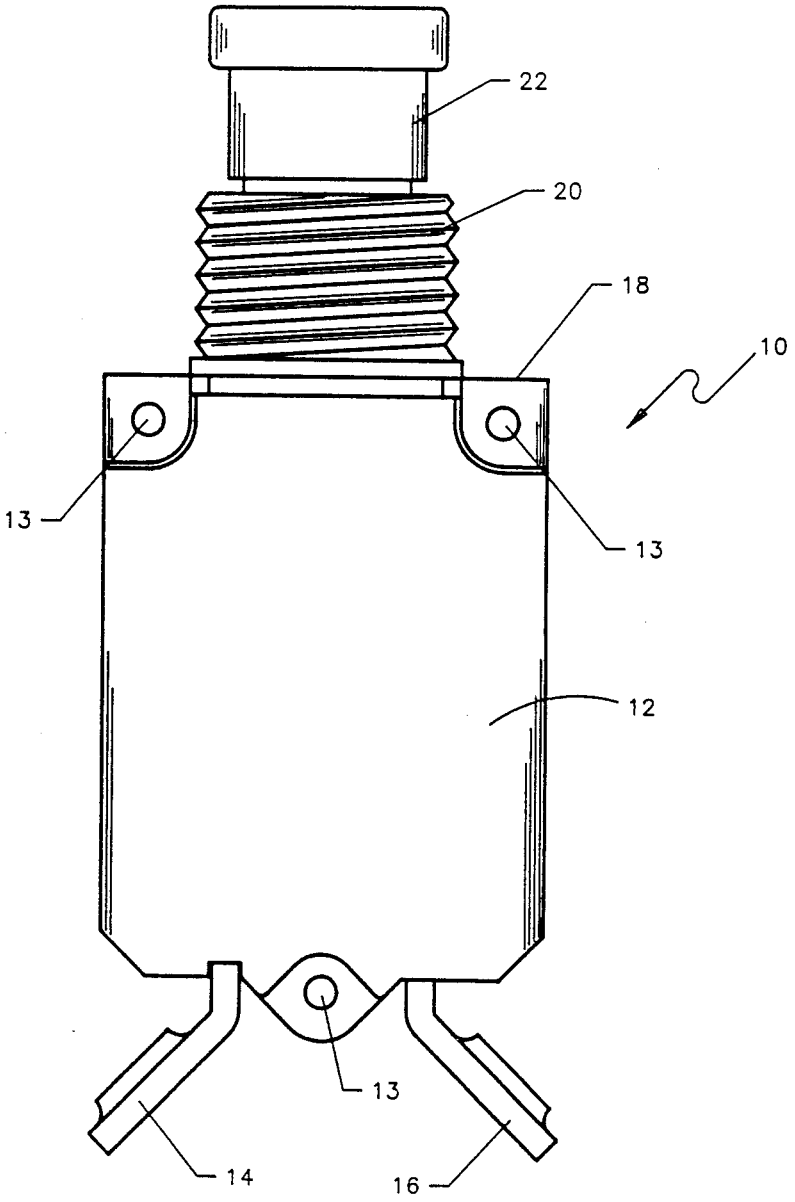
FIG. 1 is a front elevational view of a circuit breaker device made in accordance with the invention.

Referring now to the drawings, numeral 10 indicates generally a miniature circuit breaker device made in accordance with the invention. As seen in FIG. 1, circuit breaker 10 comprises a casing or housing 12 composed of rigid, electrically insulative material, line terminals 14, 16, mounting bracket 18, threaded bushing 20 and push-button 22. Housing 12 comprises first and second case halves held together by rivets 13.

Figure 2:
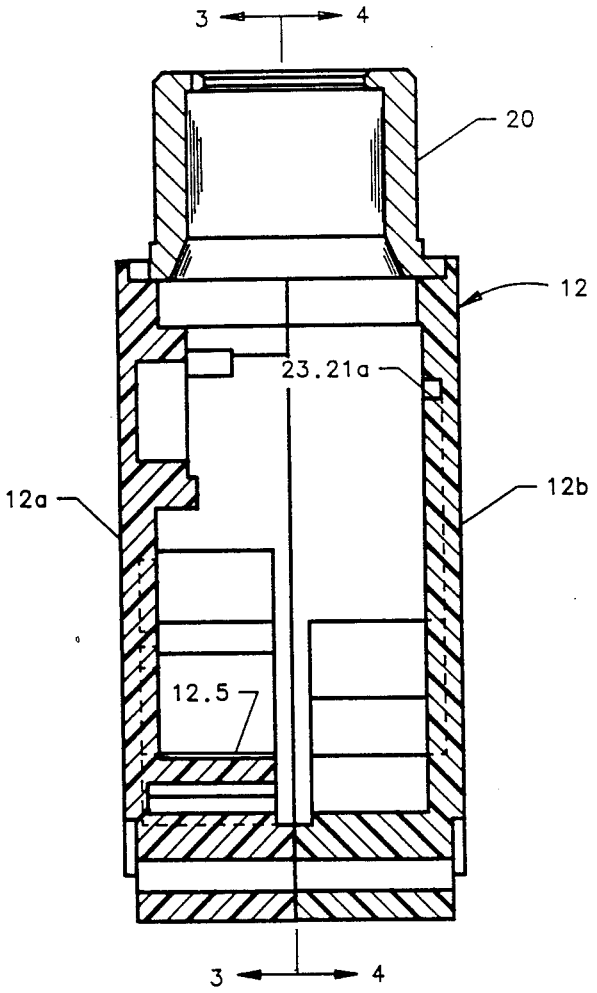
FIG. 2 is a cross sectional side view of the circuit breaker housing and mounting sleeve.
Figure 3:
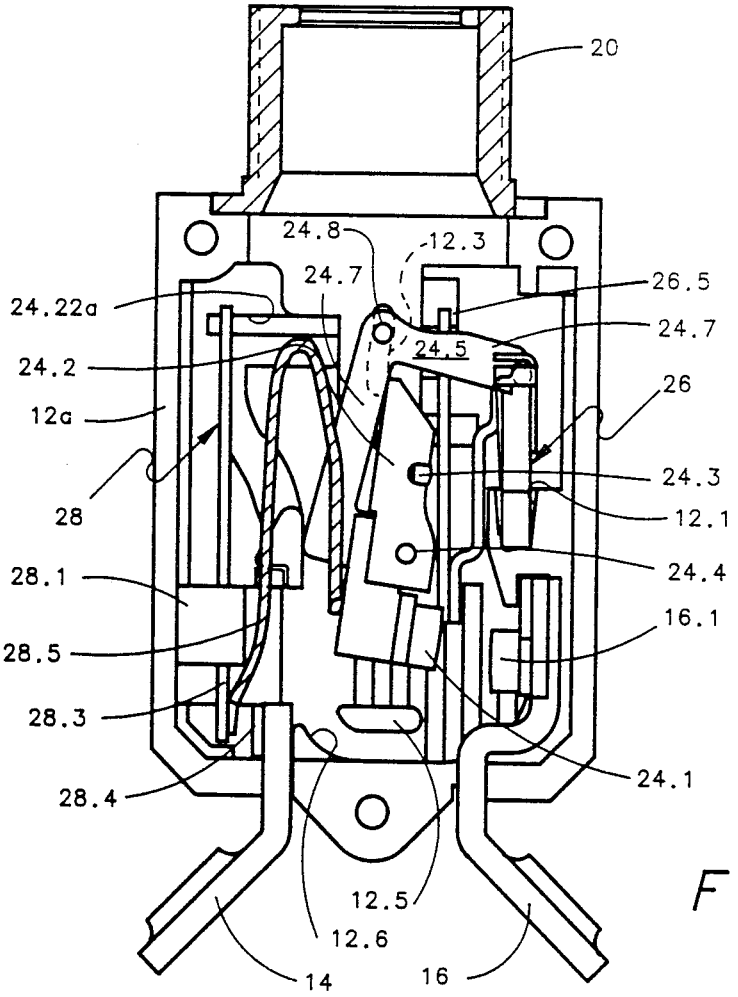
FIG. 3 is a cross sectional view taken on line 3—3 of FIG. 2 but also showing selected portions of the circuit breaker operating mechanism and terminal structure.
Figure 3A:
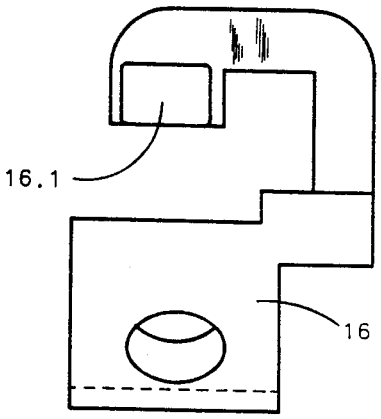
FIG. 3*a* is a side view of the stationary contact and terminal shown in FIG. 3.
Figure 4:
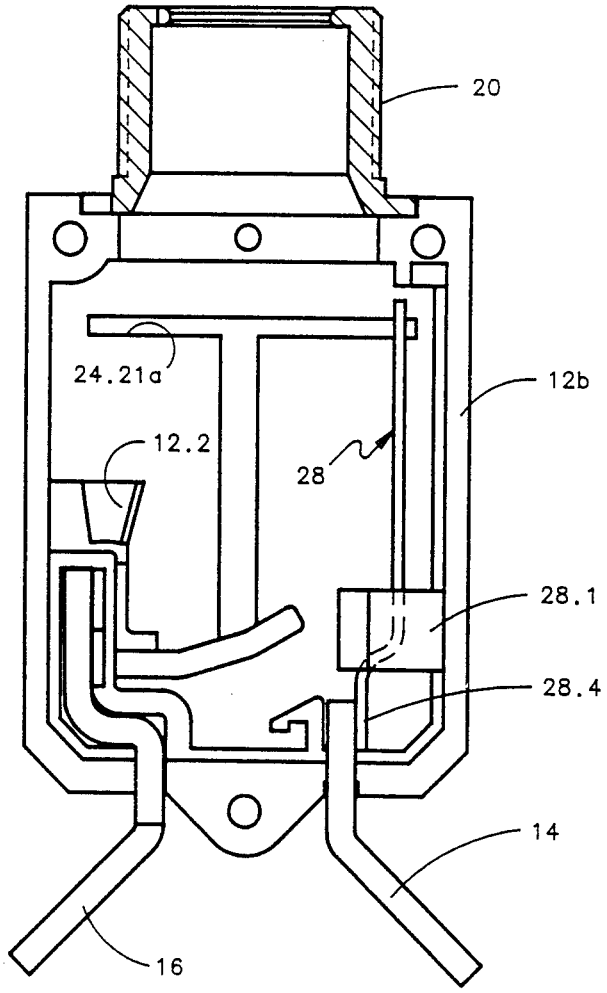
FIG. 4 is a cross sectional view taken on line 4—4 of FIG. 2 but also showing terminal structure and the overload bimetallic mechanism.

With particular reference to FIGS. 2–4 housing 12 is formed of first and second case halves 12*a* and 12*b*. As seen in FIG. 3 which is a view into the chamber formed by case half 12*a* seen on the left in FIG. 2, a stationary contact 16.1 is mounted on terminal 16 disposed in case half 12*a* (see also FIG. 3*a*). Movable contact assembly 24 disposed in case half 12*a* carries movable contact 24.1 which is adapted to move into and out of engagement with stationary contact 16.1.

A latch support plate 26 is rockably received in slots 12.1 and 12.2 formed respectively in case halves 12*a* and 12*b* as will be explained in greater detail infra.

Figure 5:
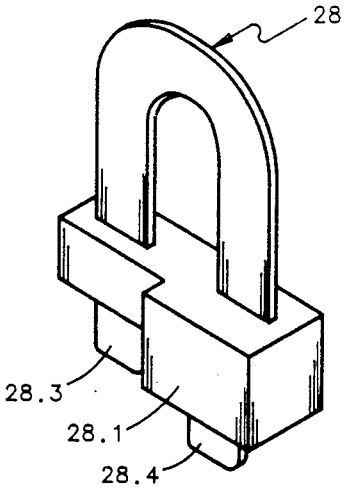
FIGS. 5–7 are perspective views of three different overload bimetallic assemblies for three different current overload ratings.
Figure 15:
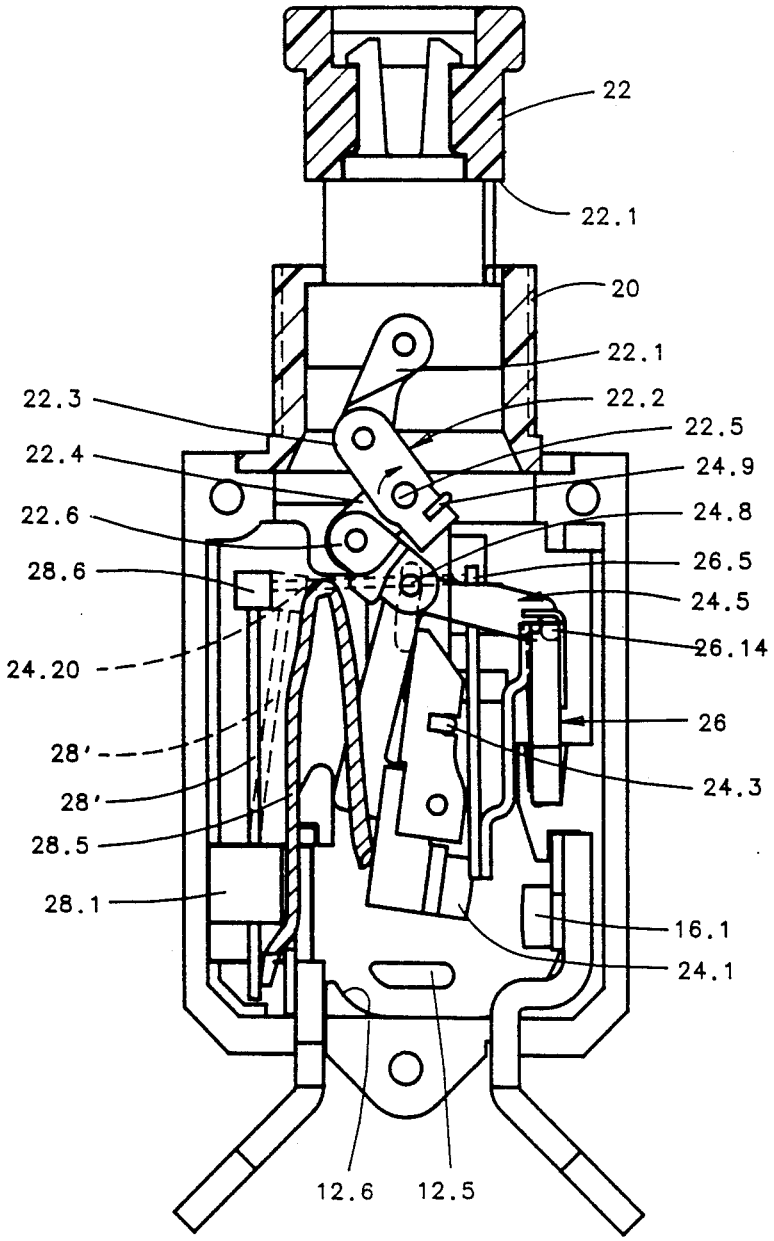
FIG. 15 is a cross sectional view taken through the mounting sleeve and a front elevational view of the remainder of the FIG. 1 circuit breaker with the front casing half removed to display the operating mechanism of the breaker.

Terminal 14 is electrically connected to the movable contact assembly, as will be seen in FIGS. 3 and 15, through the current overload bimetallic assembly 28. In the embodiment shown (see also FIG. 5) the bimetallic member comprises a strip of bimetal formed in a single U-shaped loop with its opposite ends insert molded in a block 28.1 of high temperature resinous material which is fixedly secured in the housing by use of suitable adhesive or the like. The ends of the strip extend below block 28.1 to form electrical connecting tabs 28.3 and 28.4 respectively. Terminal 14 is electrically connected to tab 28.4 by suitable means such as welding and tab 28.3 is electrically connected, as by welding, to an end of an electrically conductive, flexible pig tail 28.5.

Figure 9:
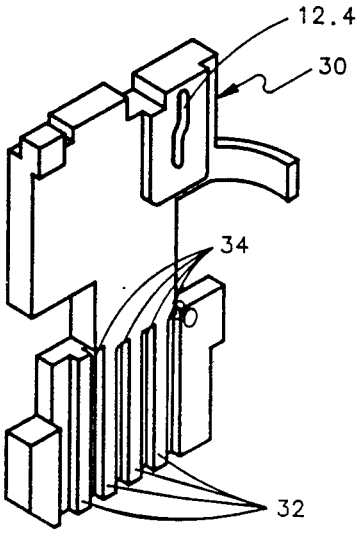
FIG. 9 is a perspective view of an arc shield used to define that portion of the housing which contains the electrical contacts.
Figure 13:
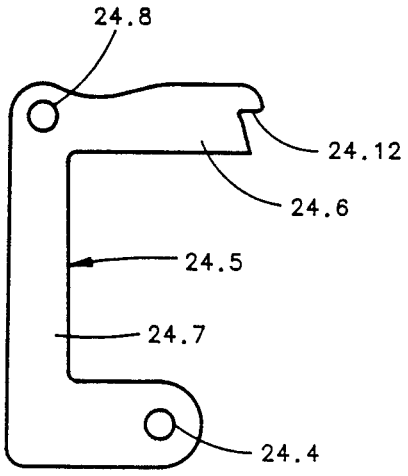
FIG. 13 is a front view of the second bellcrank element.
Figure 14:
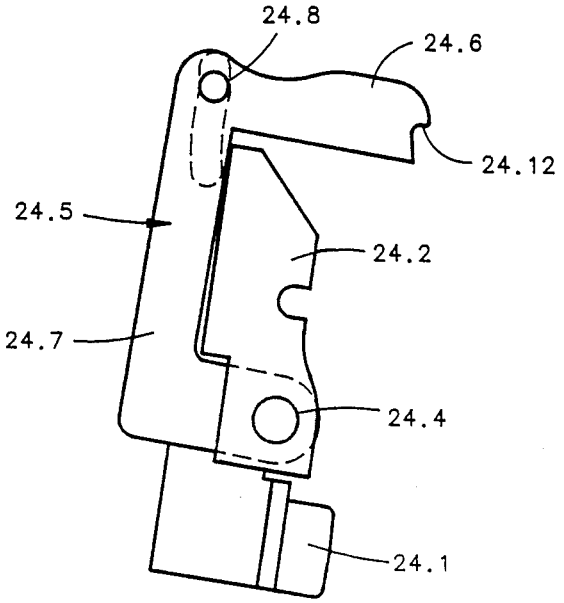
FIG. 14 is a front view of the second bellcrank element and attached movable contact arm.

Also to be noted in FIG. 3 is a contact arm return spring member 24.3 which has one end attached to movable arm 24.2 and its opposite end (not shown) received in an aperture formed in the wall of housing 12. Movable contact arm 24.2 is pivotably mounted intermediate its ends at 24.4 to a bellcrank element 24.5. Bellcrank element 24.5 (see also FIGS. 13 and 14) has first and second arms 24.6 and 24.7 extending from fulcrum 24.8. Spring 24.3 places a bias on the combination of the movable contact arm 24.2 and the bellcrank element 24.5 in a clockwise direction and a separate counterclockwise bias on the movable contact arm 24.2 urging the upper portion of the movable contact arm about pivot 24.4 as seen in FIGS. 3 and 14 toward arm 24.7 of bellcrank element 24.5. As seen in FIGS. 3 and 9 generally vertically extending slots 12.3 and 12.4 are formed respectively in case half 12*a* and an arc shield 30 to be described infra. A pin is received through an aperture formed at fulcrum 24.8 which extends between the slots to confine the fulcrum to general vertical motion to be explained in greater detail infra.

With reference to FIG. 15 bushing 20 mounts push-button 22 for sliding movement and has a push-button link 22.1 pivotably attached to the push-button at a first end of the link. The second end of link 22.1 is in turn connected to a bellcrank configured toggle link 22.2 having first and second legs 22.3 and 22.4 extending in a generally "V"shaped configuration from a fulcrum comprising a pin 22.5 received in a bore form in link 22.2. Pin 22.5 is fixedly. mounted between the casing walls with link 22.2 rotatably received thereon. Bellcrank link 22.6 has a first end pivotably connected to the distal end of leg 22.4 and a second end pivotably attached to bellcrank element 24.5 by pin 24.8. A push-button return spring 24.9 is mounted on pin 22.5 and has one end captured over toggle link 22.2 and its opposite end (not shown) fixed so that it places a clockwise moment (as seen in FIG. 15) urging the push-button and the bellcrank element 24.5 in an upwardly direction.

Figure 10:
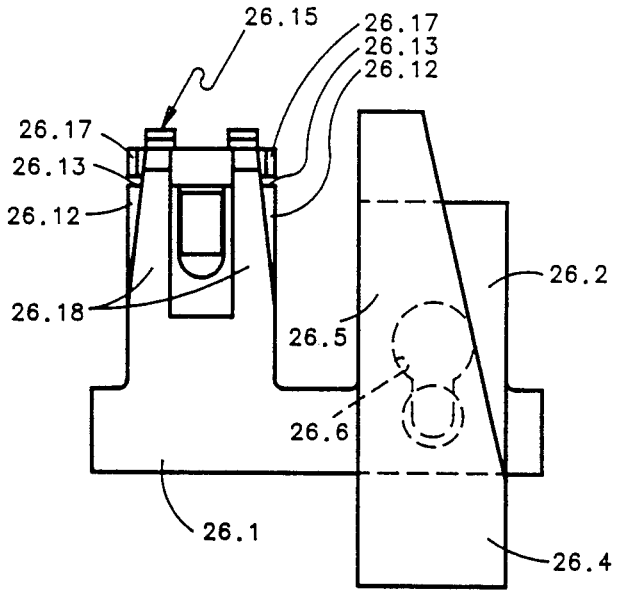
FIGS. 10 and 11 are side and front views respectively of the ambient compensating bimetallic assembly and latch support mechanism.
Figure 11:
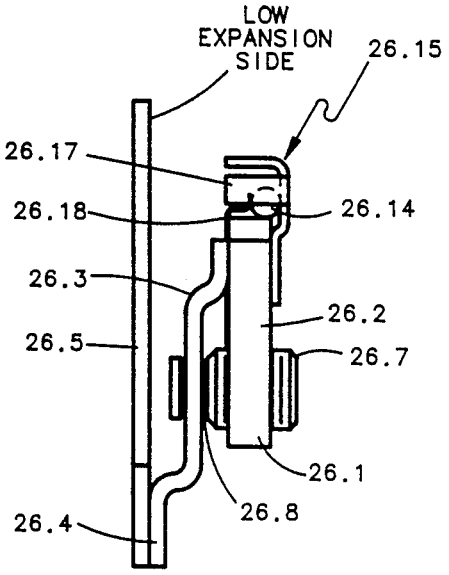
Figure 12:
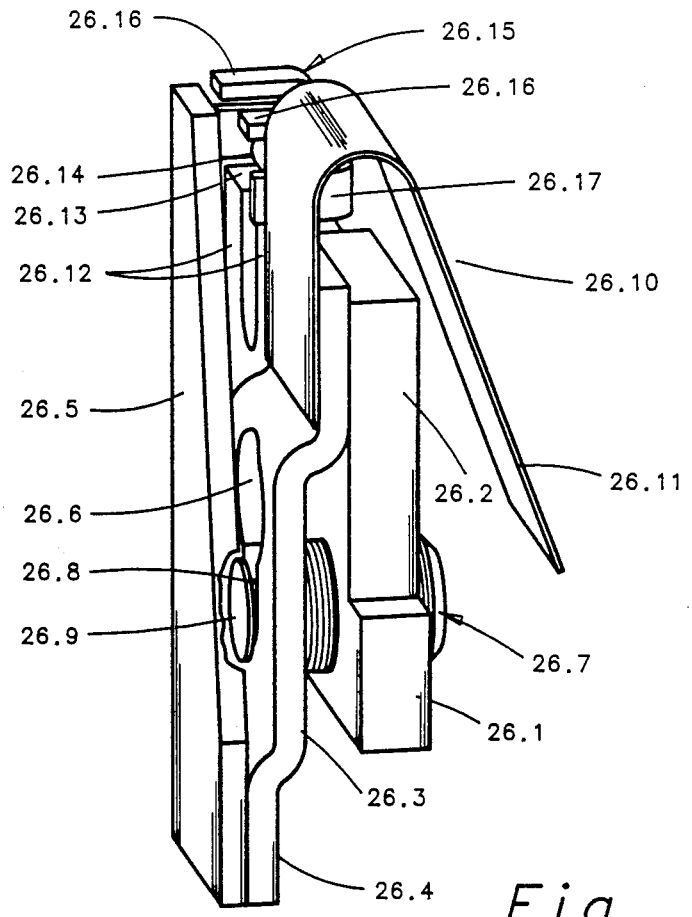
FIG. 12 is a perspective view of the structure shown in FIGS. 10 and 11.

The latch support and ambient compensating bimetallic assembly 26 is best seen in FIGS. 10–12 and comprises a support plate 26.1 which has a base portion adapted to extend across the width of housing 12 and is rockably received in slots 12.1 and 12.2 of the housing. Support plate 26.1 has an upwardly extending portion 26.2 to which a downwardly extending bracket 26.3 is fixedly attached as by welding. Bracket 26.3 extends along and has a section spaced from portion 26.2 and has a free distal portion 26.4 which is fixedly attached to one end of an elongated bimetallic strip element 26.5 to form a cantilever mount therefor. The portion of brcket 26.3 spaced from support plate 26.1 is provided with a slot 26.6 aligned with a threaded bore in support plate 26.1. Calibrating element 26.7 has a threaded shank portion received in the threaded bore, a head 26.9 and an intermediate reduced diameter portion 26.8. Slot 26.6 is formed with an enlarged circular portion which allows head 26.9 of calibrating element 26.7 to pass therethrough and a downwardly extending portion having a width suitable to receive portion 26.8 but less than the diameter of head 26.9 and the threaded portion of element 26.7 so that longitudenal movement of element 26.7 will effectively move the bimetallic element to provide selected positioning of the free end thereof for a purpose to be explained infra. A spring element 26.10 (FIG. 12) has an end attached to upper portion 26.2 of the support plate and has an opposite end 26.11 adapted to be placed against the side wall of the housing to provide a counterclockwise force as seen in FIG. 12 urging the support plate away from the side wall.

Also extending upwardly from support plate 26.1 are spaced legs 26.12 which have a top surface portion 26.13 on which is rollably received a cylindrical pin 26.14 which serves as a reaction surface cooperating with latching surface 24.12 on bellcrank 24.5 to be discussed below in greater detail. A cage 26.15 is mounted on legs 26.12 to maintain pin 26.14 on surface 26.13 comprising a pair of tabs 26.16 extending upwardly from the support plate to limit motion of the pen to the rear of the cage (to the right as seen in FIG. 11) and extending over but spaced from surface portion 26.13 and side walls 26.17. Preferably a spring member 26.18 (FIGS. 10 and 11) which may be in the form of a U-shape configuration having free distal end portions is adapted to contact pin 26.14 in order to urge the pin toward the back of the cage.

A motion transfer plate 24.20 is received in housing 12 with sides 24.22 and 24.21 adapted to slide in groves 24.21*a* and 24.22*a* formed in front and back walls of the housing (see FIGS. 3 and 4) between the distal free portions of over-current bimetallic element 28 and ambient compensating bimetallic element 26.5. By means of plate 24.20 displacement of the free end of over-current bimetallic member 28 will be transferred to compensating bimetallic element 26.5 and concomitantly support plate 26.1. As ambient temperature fluctuates the free distal ends of the over-current and ambient bimetallic strips are displaced in equal amounts so that the position of support plate 26 is unaffected.

Figure 6:
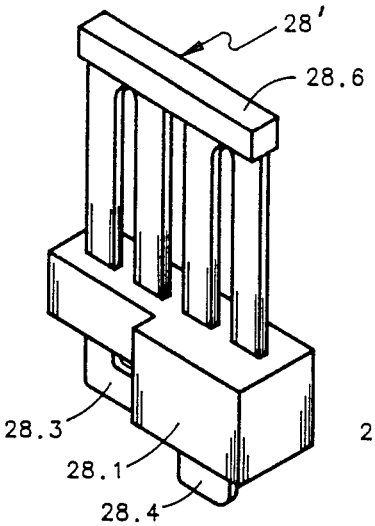
Figure 7:
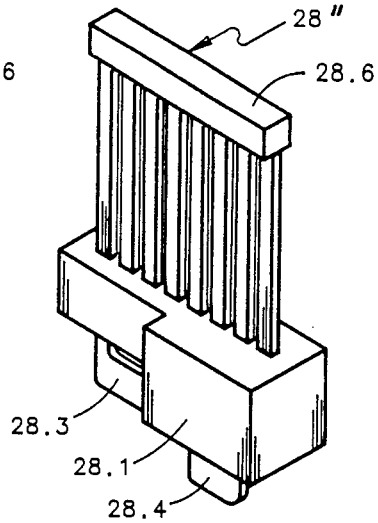
Figure 8:
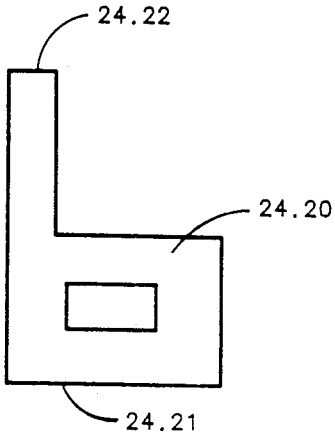
FIG. 8 is a top plan view of a motion transfer slide member used to transfer motion between the bimetallic elements.

As shown in FIG. 15 the over-current bimetallic assembly takes the form of that shown in FIGS. 6 (28') or 7 (28''), in which the strip of bimetallic material is formed into a plurality of loops extending back and forth between two extremities with the bottom, one extremity, insert molded in block 28.1 as described supra, and the top, the other extremity, insert molded in another block 28.6 of high temperature resinous material. Block 28.6 serves to maintain the loops of the bimetallic element in alignment and provides improved immunity to vibration. The particular bimetallic assembly chosen among the FIGS. 5–7 embodiments is dependent upon the selected current rating for the breaker. As seen in FIG. 15, bimetallic assembly 28' has block 28.6 aligned with slide plate 24.20 (shown in dashed lines) with the other end of plate 24.20 aligned with the free distal end of bimetallic strip 26.5.

With particular reference to FIGS. 16–20 operation of the toggle and latching assemblies will be described. FIG. 16 shows the circuit breaker in the at rest, unactuated position. In that position push-button return spring member 24.9 maintains the push-button in the up position and the contacts 24.1, 16.1 in the contacts open disengaged position by means of the clockwise bias (as seen in FIGS. 16–20—see arrow around pin 22.5) on toggle link 22.2. It will be noted that latch surface 24.12 of bellcrank 24.5 is spaced from reaction surface 26.14.

Depressing push-button 22 causes the second (lower) end of puch-button link 22.1 to rotate toggle pin 22.2 in a counterclockwise direction against the bias of spring 24.9 causing fulcrum 24.8 through leg 22.4 to move downwardly with pin 24.8 sliding in grooves 12.3, 12.4 until latch surface 24.12 contacts reaction surface 26.14 (FIG. 17), which then causes the bellcrank element to pivot counterclockwise as it continues its downward movement.

Although the grooves 12.3, 12.4 define generally a vertical path a slight arc (having a radius equal to the length of arm 24.6) is formed intermediate its extremities so that once the latch surface engages the reaction surface of pin 26.14 further downward movement of bellcrank element 24.5 will not cause any rocking movement of support 26. That is, there will be only pivoting motion of the distal free end of arm 24.6 with no lateral component of motion. This, along with spring member 26.18 maintaining pin 26.14 at the rear or inside extremity of the pin cage 26.15 insures that the position of latching surface 24.12 relative to the reaction surface of pin 26.14 is always the same when the contacts are closed to provide improved consistency of the current level at which the breaker will trip.

Figure 19:
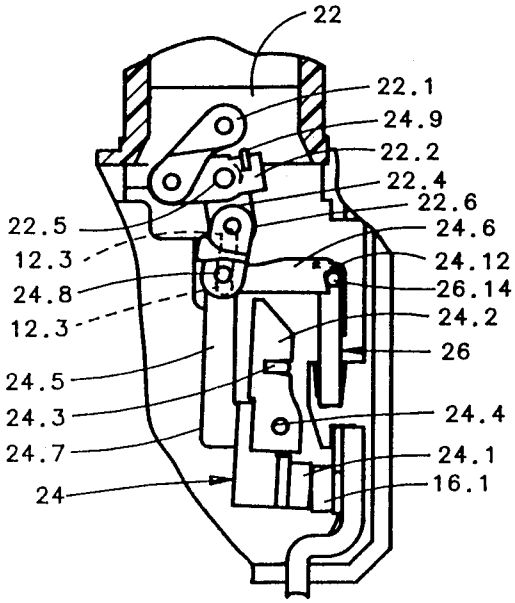
FIG. 19 is a view similar to FIG. 16 showing the device in the contacts closed, fully latched position.

Continued downward movement of the bellcrank element causes the bottom portion of movable contact 24.1 to engage stationary contact 16.1 (FIG. 18) causing the opposite end of movable arm 24.2 to move away from leg 24.7 of bellcrank element 24.5 against the bias of contact arm return spring 24.3 with contact 24.1 sliding on the contact 16.1 in a downward direction until the pin on the first leg 22.4 of bellcrank toggle 22.2 moves beyond an imaginary line extending through fulcrum 24.8 and fixed fulcrum point 22.5 with the movable contact sliding upwardly a slight amount with the travel of the pivot point beyond the center position. This position is shown in FIG. 19 and represents the latched, closed or contacts engaged position. Further downward movement of push-button 22 is limited by shoulder 22.1 contacting bushing 20 as best seen in FIG. 15.

Figure 20:
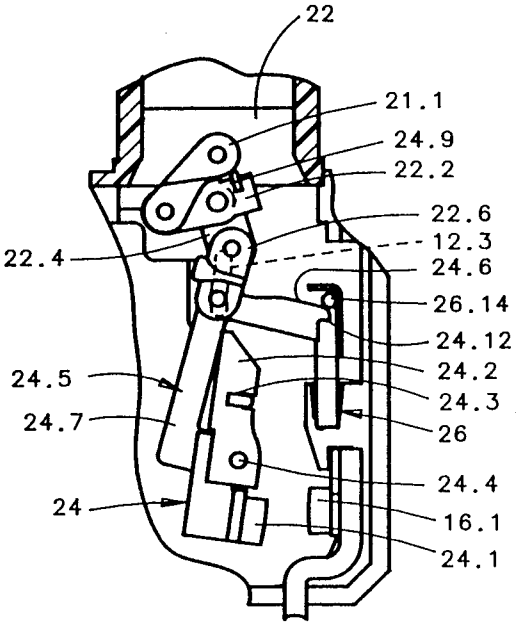
FIG. 20 is a view similar to FIG. 16 showing the circuit breaker in the contacts open, tripped position.

FIG. 20 shows the device at the movement of thermal trip. As noted by the dashed lines of assembly 28' in FIG. 15, over-current causes the bimettalic assembly to heat up and displace block 28.6 to the right. This causes slide plate 24.20 to transfer motion to support plate 26 to rock with the upper portion moving away from the latching mechanism and cylindrical reaction surface 26.14 to roll away from latching surface 24.12 until the latching surface is no longer supported. This allows contact arm return spring member 24.3 to move the movable contact arm 24.2 and leg 24.7 of bellcrank element 24.5 away from stationary contact 16.1 and further allows push-button return spring 24.9 to rotate toggle link 22.2 to lift the movable contact assembly and the push-button upwardly to the FIG. 16 position. The rolling action of pin 26.14 between surfaces 26.13 and 24.12 involves very little frictional force and consequent wear which results in a device in which the calibration is much more consistent over extended periods of time to significantly extend the useful life of the device.

For a manual trip the push-button 22 is pulled upwardly lifting latching surface 24.12 off reaction surface 26.14 thereby allowing push-button return spring 24.9 to rotate toggle 22.2 to move movable contact away from stationary contact 16.1.

Another feature which enhances device longevity is the improved contact system employed in the invention. Although contact systems used for high capacity applications conventionally use tungsten as a means for extending life, the present system uses a non-refractory material such as silver cadmium oxide and provides a single break contact system to ensure maximum contact force and therefor minimum contact resistance. Further, the contacts are mounted on structures which result in elecromagnetically directing the arc between the contacts in a downwardly direction between the bottom wall of the casing and a spaced wall 12.5 forming a curved arc chute. This structure includes terminal 16 which forms a loop leading up, then transversely across the switch chamber and then downwardly to stationary contact 16.1 and flexible pig tail 28.5, forming a loop leading in a direction up and away from movable contact 24.1. An arc barrier 30 (FIG. 9) is placed between the case halves—in the central portion seen in FIG. 2—and serves to separate the switching chamber from the remainder of the device. A plurality of lands and grooves 32, 34 respectively are formed in both the arc barrier 30 and the front and bottom walls of casing half **12*a* to provide a plurality of arc shadows to prevent continuous tracking of contact material such as silver sprayed by the arc. The bottom wall of case half 12*a* is curved at 12.6** to direct the arc beyond the chute into a remote portion of the chamber preventing back pressure and to allowing dissipation of the arc.

Figure 21:
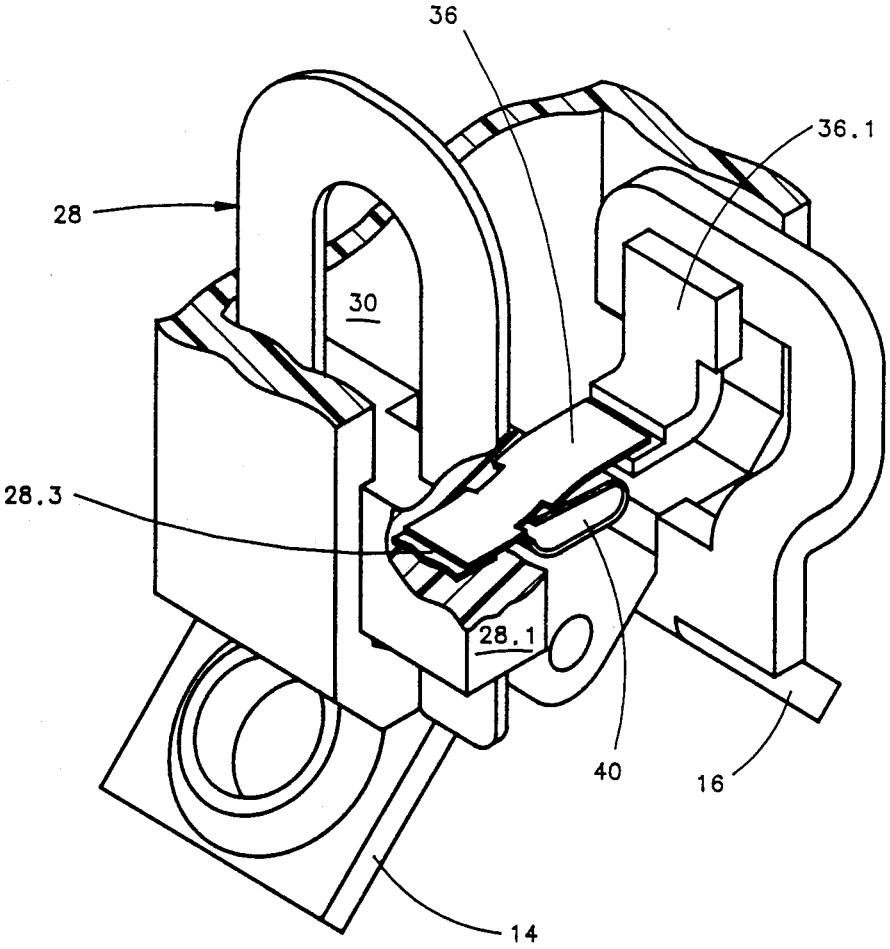
FIG. 21 is a perspective view of the bottom portion of the device taken from the rear with the back case half removed.

FIG. 21 shows a modification of the device in which a dual safety function is provided. A connecting strap 36 is mounted in the housing and electrically connected in series between the bimetal assembly 28 and the pigtail 28.2 (not shown). In the FIG. 21 structure pigtail 28.2 would be welded between tab portion 36.1 and movable contact arm 24.2. Connecting link 36 is connected to tab portion 28.3 of the bimetal assembly 28 by a low melting alloy solder of the same type as disclosed and claimed in U.S. Pat. No. 4,400,677, assigned to the assignee of the instant invention. Overheating caused by excessive current flow through bimetal 38 causes melting of the solder connection and spring 40 disposed beneath the connecting link then separates the remainder of link 36 from tab portion 28.3.

In view of the above, it will be seen that the several objects of the invention are achieved and other advantageous results attained.

As various changes could be made in the above described instructions without departing from the scope of the invention, it is intended that all matter contained in the above description as well as shown in the accompanying drawing shall be interpreted as illustrative and not in a limiting sense.

What is claimed is:

1. A switching device comprising a housing having walls defining a chamber therein, stationary contact means and movable contact means mounted in the chamber, the movable contact means adapted to move into and out of engagement with the stationary contact means, actuating means extending from outside the housing into the chamber coupled to the movable contact means adapted to move the movable contact means and latching means disposed in the chamber adapted to maintain the stationary and movable contact means in engagement during selected conditions, the actuating means comprising a push-button mounted on the housing adapted for movement between first and second limits, a push-button link member having first and second ends, the first end pivotably connected to the push-button, a toggle link having first and second ends and an intermediate fulcrum, the first end of the toggle link being pivotably connected to the second end of the push-button link, the fulcrum being povotably mounted on a pin fixedly mounted in the housing, a bellcrank link having first and second ends, the first end of the bellcrank link pivotably connected to the second end of the togle link, a bellcrank element having first and second ends and an intermediate fulcrum, the fulcrum of the bellcrank element pivotably connected to the second end of the bellcrank link through a pin, a pair of gnerally vertically extending grooves formed in the housing, the pin extending between and into the grooves to limit motion of the fulcrum of the bellcrank element to generally vertical motion, the first end of the bellcrank element formed with a latching surface adapted to move into and out of engagement with a reaction surface of the latching means, the second end of the bellcrank element being coupled to the movable contact means whereby downward movement of the push-button will cause the toggle to pivot and move the latching surface into engagement with the reaction surface and continued downward movement of the push-button will cause the fulcrum of the bellcrank element to move downwardly with the movable contact means engaging the stationary contact means and the first end of the bellcrank link moving laterally from a point relative to an imaginary line extending through the fulcrum of the toggle link and the fulcrum of the bellcrank element away from the latching surface to a point across the imaginary line which is toward the latching surface.

2. A switching device according to claim 1 in which the movable contact means includes an elongated arm having first and second ends, the movable contact mounted at the first end of the arm, the elongated arm being pivotably connected intermediate its first and second ends to the second arm of the bellcrank element and a spring means is mounted in the housing and places a bias on the elongated arm between its pivot and its second end urging the second end of the elongated arm toward the second arm of the bellcrank element.

3. A switching device according to claim 2 in which the spring means placing a bias on the elongated arm also biases the second arm of the bellcrank element in a direction away from the stationary contact.

4. A switching device according to claim 1 further including a contact return spring mounted in the housing and placing a bias on the bellcrank toggle link tending to lift the fulcrum of the bellcrank element and the push-button upwardly through the bellcrank link and the push-button link respectively.

5. A switching device according to claim 1 in which the generally vertically extending grooves in which pin extending through the fulcurm of the bellcrank toggle link rides is formed with an arc intermediate its ends so that the latching surface of the bellcrank element and the reaction surface of the latching means maintain the same spatial relationship relative to one another when the push-button is depressed.

6. A switching device according to claim 1 further including first and second terminals for providing a current source to the stationary and movable contacts means respectively, a connector link connected in series with one of the first and second terminals connected at an end thereof to said one of the terminal means by a solder joint and a spring compressed against the connector link so that upon melting of the solder due to over temperature conditions the spring well separate the said end of the connector link from the said one of the terminal means.

7. A switching device according to claim 1 further including first and second terminal means for providing a current source to the stationary and movable contact means respectively, a cantilever mounted bimetallic current carrying assembly electrically connected between one of the terminal means and one of the contact means having one end fixedly supported in the housing and having a second distal end adapted to deflect upon being subjected to selected current conditions, the distal end of the bimetallic assembly operatively connected to the reaction surface of the latching means.

8. A switching device according to claim 7 further including an ambient compensating bimetallic assembly connected between the current carrying assembly and the reaction surface.

* * * * *